United States Patent [19]

Heavener

[11] Patent Number: 4,579,224

[45] Date of Patent: Apr. 1, 1986

[54] GAME BOARD EQUIPMENT CARRIER

[76] Inventor: C. Paul Heavener, 3455 William Dr., Newbury Park, Calif. 91320

[21] Appl. No.: 559,979

[22] Filed: Dec. 9, 1983

[51] Int. Cl.[4] ..... B65D 69/00; A63F 3/00

[52] U.S. Cl. ..... 206/315.1; 206/579; 273/282

[58] Field of Search ..... 206/315.1, 574, 575, 206/579, 232, 592, 214; D3/74; 273/282, 285, 287

[56] References Cited

U.S. PATENT DOCUMENTS

| | | | |
|---|---|---|---|
| 1,549,610 | 8/1925 | Reisz | 273/285 |
| 1,549,611 | 8/1925 | Reisz | 206/315.1 |
| 2,427,318 | 9/1947 | Warren | 206/315.1 |
| 2,680,514 | 6/1954 | St Pierre | 206/579 |
| 2,794,641 | 6/1957 | Baker et al. | 273/282 |
| 3,151,741 | 10/1964 | Haecker | 206/579 |
| 3,504,915 | 4/1970 | Walker | 206/315.1 |
| 3,773,328 | 11/1973 | Seidman | 206/315.1 |
| 3,933,241 | 1/1976 | Tassone et al. | 206/579 |
| 4,154,339 | 5/1979 | Dutra | 206/315.1 |
| 4,302,013 | 11/1981 | Karis | 206/315.1 |
| 4,511,036 | 4/1985 | Castelli | 206/214 |

FOREIGN PATENT DOCUMENTS

| | | | |
|---|---|---|---|
| 78616 | 8/1930 | Sweden | 273/287 |

*Primary Examiner*—William Price
*Assistant Examiner*—Brenda J. Ehrhardt
*Attorney, Agent, or Firm*—Poms, Smith, Lande & Rose

[57] ABSTRACT

A container for game board pieces and other equipment, such as dice and cards, has a carrying and storing handle, and is provided with a partially open area on one side thereof. A flat member is fastened by hinges to the container and folds forward to at least partially close the open area of the container. There is enough space between this hinged flat member and the container so that the game board will fit between these two parts. The game board is held in place as a result of pins extending from the container through the game board and making frictional engagement with the holes in the flat hinged member. The flat hinged member may alternatively be held in assembly with the game board by straps, and either the pins or straps may be employed to hold the flat hinged member over the open area of the container when it is desired to store the game pieces without securing the container to the game board. The handle may have a slight central recess for convenience in mounting a number of the units on a pegboard or the like.

9 Claims, 7 Drawing Figures

GAME BOARD EQUIPMENT CARRIER

FIELD OF THE INVENTION

This invention relates to containers and display mounting arrangements for game boards and their associated equipment.

BACKGROUND OF THE INVENTION

Game boards are normally sold in boxes which contain the game board and also hold the game board pieces, and other equipment such as dice and/or cards which may be used in the game. These boxes are normally stored for sale on shelves, with the boxes stored flat, and with very little space available on the exposed side of the box for point of purchase advertising or the like. In addition, the cardboard boxes tend to be somewhat oversize and take up more space than would be desired by the customer. Also, the boxes tend to be somewhat fragile and break within a period of time, so that the game board pieces and other euipment may easily be lost or mislaid.

Accordingly, one object of the present invention is to provide a package for game boards which lends itself more readily to larger area point-of-purchase advertising, without requiring additional storage area, on an overall basis, for the retailer.

Another object of the present invention is to provide a simple, compact, durable and convenient way for storing game board pieces and other equipment either in conjunction with or separate from the game board itself.

SUMMARY OF THE INVENTION

In accordance with the present invention, a container for holding the game board pieces and related equipment such as dice, cards, or the like, is provided with a handle, and an open area on one side of the container. A flat member is hingedly secured to the container to fold down and at least partially cover the open area of the container. This hinged flat member is arranged to accomodate the mounting of the game boards between this hinged flat member and the container itself, and arrangements are provided for securing the game board to the container in this configuration.

Additional features or aspects which may be included in the invention, include the following:

1. The hinged flat member may be provided with holes which frictionally engage pins extending outwardly from the container, and the board game may be provided with a pair of corresponding holes near one edge thereof, so that the flat member may be folded down to engage the pins with the game board over the pins, thus holding the assembly together.

2. Alternatively, the game board may be held in place by straps extending from the container to the flat hinged member.

3. The side of the container against which the hinged member closes, may be covered by a plate which may be either fixed or snapped in place, so that, when the hinged flat member is closed, the container is substantially closed, whether the game board is in place or not.

4. The container, its handle, and the hinged flat member, together with the hinges for the flat member, may be molded with a single molding operation, preferably with the flat member having an area approxixmating the space within the handle, secured to the carrier. The pins may also be molded in the same operation. This configuration simplifies the molding process, and the only necessary assembly step is the securing of a member on the open side of the container to at least partially close it. This additional part may be either cemented into or snapped into place, as a single element or as a pair of members.

5. The handle may be provided with a small central inner recess to facilitate the uniform mounting of a series of the units on a pegboard pin, or the like.

6. The containers may be either sold to accomodate existing board games, or may be sold together with a new board game and the necessary equipment to play the game.

7. The boards as they are mounted in place may be either doubled over as is normal with conventional prior board games, or they may be fully extended. In either case, there will be a substantial area for point-of-purchase advertising and sales material on the surface of the board which is exposed.

As mentioned above, an important advantage of the present invention is that it permits the mounting of game boards on pegboard pins or the like so that a much larger surface area for point-of-sale advertising is provided than is the case of the sides of boxes which would be visible in prior merchandising arrangements of game board boxes. Further, where the units are stored on a pegboard pin, one behind the other, there is no greater total space taken up by the new arrangement than was occupied by the prior boxes of game boards. In addition, the overall storage requirements are reduced and convenience for the ultimate consumer are significantly increased by the present invention.

As viewed from another aspect, the present invention which involves a game board and equipment carrying assembly, may be formed as a plastic moulding including a container for the game board equipment (game pieces, dice, cards etc.), a handle which could include the container or be attached thereto, a living hinge for interconnecting two portions of the moulding, and arrangements for securing a game board to the plastic moulding.

Other objects, features and advantages of the invention will become apparent from a consideration of the following detailed description and from the accompanying drawings.

DETAILED DESCRIPTION

Figure 1:
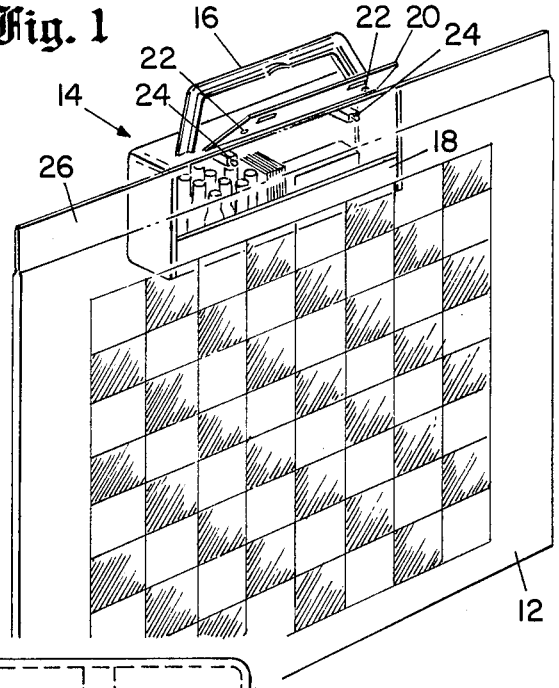
FIG. 1 shows a container and board game arrangement illustrating the principles of the present invention.

Referring more particularly to the drawings, FIG. 1 shows a game board 12 and a container 14 including a handle 16 for mounting the game board 12 in a point of sale display. The container 14 includes an open side which is partially closed by a plate member 18, and the hinged flat plate member 20 folds down to partially closed the remaining area of the container 14. The member 20 is provided with openings 22 which make frictional engagement with the pins 24 which extend outwardly at the top of the open area of the container 14. The board 12 has corresponding openings along its upper edge 26 which slide over the pins 24, so that, when the hinged member 20 is closed down on the outer side of the board 12, the board 12 closes the open side of the container 14, making a complete closed assembly.

Figure 6:
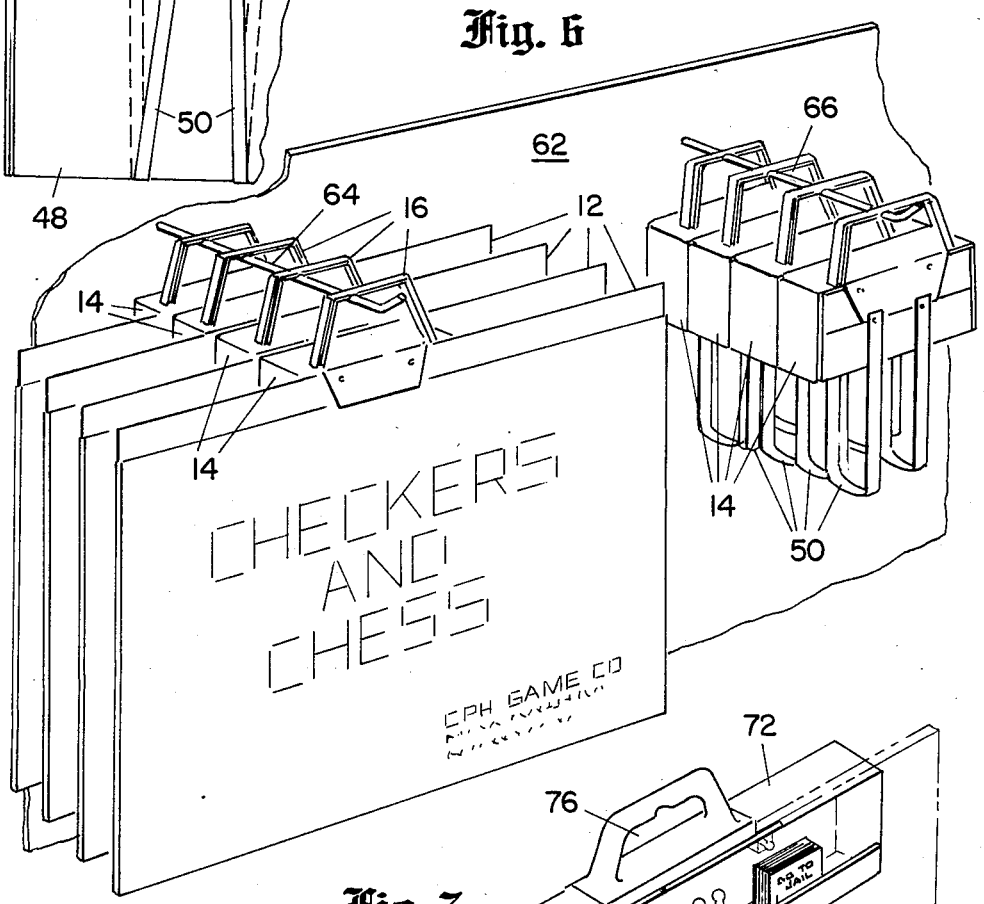
FIG. 6 shows point-of-sale mounting arrangements for game boards illustrating the principles of the invention.

On one side of the board 12 is the game configuration such as the checker or chess board shown in FIG. 1, and on the other side of the board may be point-of-sale advertising or descriptive information, as shown in FIG. 6. It is to be expected that colorful and imaginative point-of-sale material relating to new games, will normally appear in the area made available and shown in FIG. 6.

Figure 3:
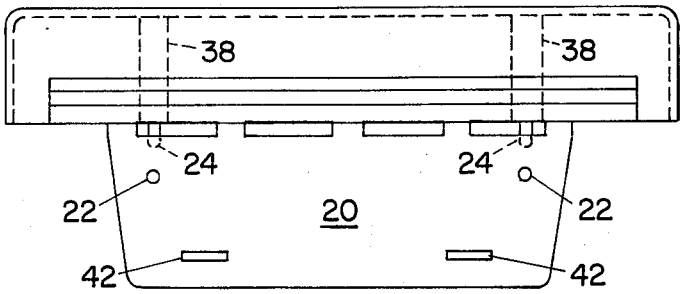
FIGS. 2, 3 and 4 are detailed drawings showing front, top, and side cross-sectional views, respectively, of an arrangement illustrating the principles of the invention.
Figure 2:
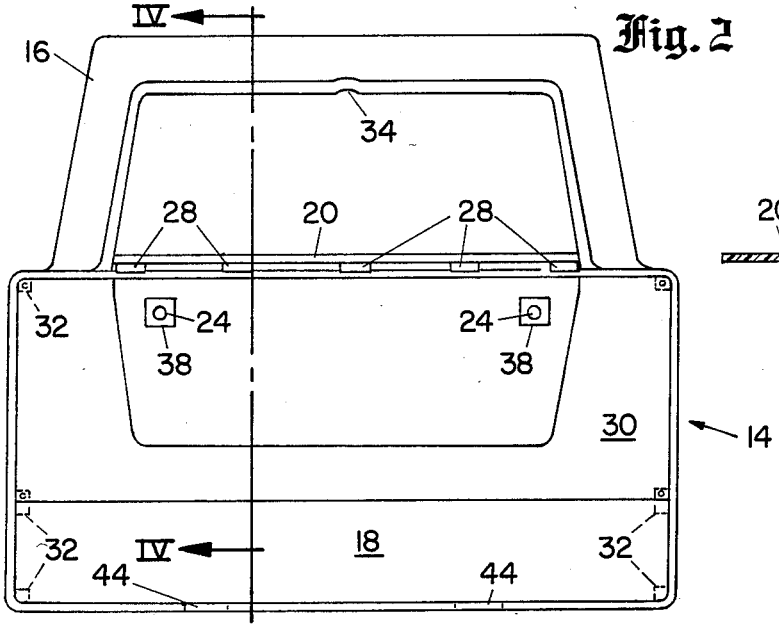
Figure 4:
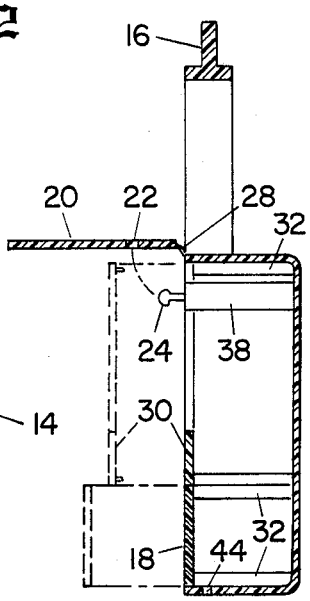

FIGS. 2, 3 and 4 are more detailed views of the container 14, and show its construction details. More specifically, it may be noted from FIG. 2 that the flat member 20 is of slightly smaller configuration than the handle 16, to simplify molding of the unit, with the exception of the plate 18, all in a single unit. This molding operation would include the so-called "living" hinges 28 by which the flat plate member 20 is secured to the upper edge of the container 14.

In addition to the plate member 18, the container 14 may be provided with a second plate member 30 which will substantially cover most of the open side of the container 14 which is not to be covered by the member 20. The members 18 and 30 may be formed as a single plate, if desired. Alternatively, they both may be cemented in place to the molded supporting elements 32 which are shown in FIGS. 2 and 4. As a third alternative, the plate 30 may be snapped and/or hinged into place with suitable recesses engaging small protruberances in the plate 30 in accordance with known plastic materials assembly techniques. The handle 16 may be provided with a small central recess 34 to facilitate alignment of the units when they are mounted in a display rack, as shown in FIG. 6.

It is, of course, understood that the plates 18 and 30 are not initially molded, but may be either cut from flat sheet plastic stock, or molded separately, as desired. The pins 24 are mounted on supports 38 which are molded concurrently with the formation of the container. If desired, the elements 38 may be connected with a rib to the upper wall of the container 14.

Slots 42 (see FIG. 3) may be provided to receive straps as an alternative method for securing the unit together, particularly when not sold as an initial installation. Additional slots 44 may be provided in the bottom of the container to receive the other ends of the straps.

It is to be understood, of course, that in the showings of FIGS. 3 and 4, the flat hinged member 20 is shown extending out perpendicularly to the front face of the container 14, while in FIG. 2 the member 20 is shown folded into its vertical or upwardly extending configuration so that the technique for molding this closure member concurrently with the handle 16 may be considered.

Figure 5:
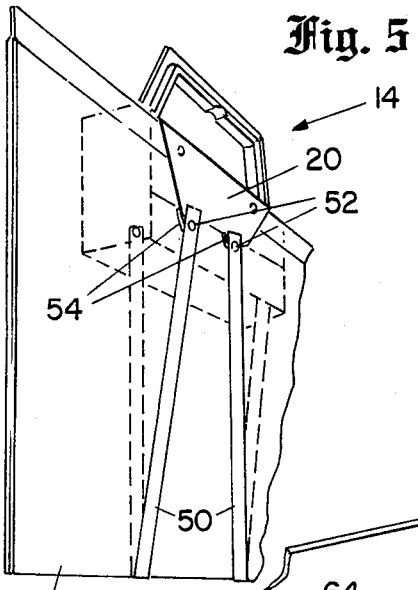
FIG. 5 shows an arrangement in which straps are employed for securing the game board to the equipment container.

FIG. 5 shows a board 48 being mounted to the container 14 by straps 50. The straps 50 may be secured to the container 14 and to the hinged member 20 in any desired manner. In the showing of FIG. 5, the straps are shown being provided with pins 52 which engage plastic loops 54 which are secured to the flat hinged member 20. However, it is to be understood that the straps 50 could be provided with metal or plastic clips which would extend through the slots 42 or the straps themselves could extend through the openings 42, as shown in FIG. 3, and the straps could be secured back into engagement with themselves through Velcro pads or the like. If desired, the straps 50 may be made of resilient material to provide slight tension in holding the board 48 in position. The board 48 is shown doubled over, in FIG. 5, in the manner of conventional practice for existing board games.

Concerning the construction of the boards themselves, they may be of laminated configuration, or provided with an outer coating of plastic material, to improve durability. In addition, they may be employed either doubled over, in the manner shown in FIG. 5, or fully extended, for example, with a full 19 inch by 19 inch area for point-of-sale advertising. In this regard, it is noted that the full 19 inch by 19 inch board area would give 361 square inches of selling space, as compared with about 24 inches provided by the 19 inch by 1¼ inch size of the side of the game board box which is normally all that is available for sales display purposes in a retail store, when the game boxes are stored on shelves.

FIG. 6 shows a point of sale arrangement with a pegboard 62 providing outwardly extending mounting pins 64 and 66. A series of game boards 12 are shown mounted by the handles 16 on the containers 14. Mounted on the pins 66 are a series of containers 14 provided with straps 50 for use with any of a number of games, and for purchase by persons who already have board games.

Figure 7:
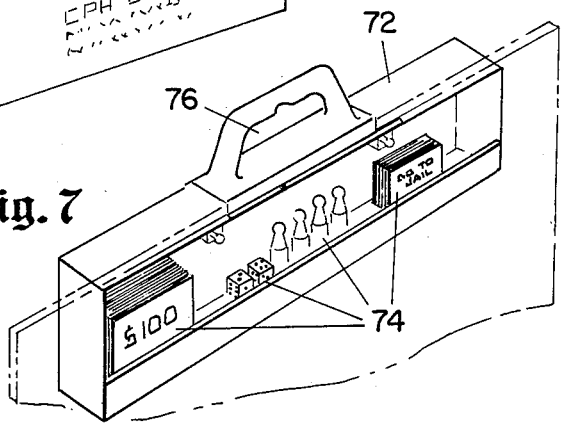
FIG. 7 shows an enlarged container unit applicable to certain types of games involving more equipment than most other games.

FIG. 7 shows an alternative arrangement wherein the container 72 is of a somewhat larger capacity than that shown in the prior figures of the drawings, to accommodate more game pieces and equipment 74 than is found in the usual game. In addition, the handle 76 is of slightly different configuration than that shown in the prior figures of the drawings. The other features, such as the hinged plate member, and the like, may be as described hereinabove, although they are not shown in detail in FIG. 7.

It is to be understood that the embodiments shown and described in detail hereinabove are merely illustrative of the principles of the invention. Other arrangements, such as the construction of the device from sheet materials rather than molded as a single unit, would be included within the scope of the present invention, as would the use of partitioned containers; and the use of containers of the type disclosed hereinabove for carrying other flat materials, such as embroidery work, paintings in preparation, or other similar situations where extended flat areas and related equipment are to be sold or carried. Also, as another alternative, the handle could be made of much greater cross-sectional dimensions, hollow, and hinged, to contain game equipment, and merely have two complementary plates extending down each side of a game board, and held together in the manners described hereinabove. As another variation, instead of using an outer plastic layer in a laminated assembly to provide waterproofing, a transparent plastic bag with sealing edge arrangements, could fit precisely over a non-waterproof game board and be secured in place either by straps of by the pins extending through the bag and/or the game board. Accordingly, it is to be understood that the present invention is not limited to that as shown and described in detail hereinabove.

What is claimed is:

1. A game board assembly comprising:

a container for holding game board pieces and/or related equipment such as dice, cards or the like;

a carrying handle secured directly to said container;

said container having an open area on one side thereof for providing access to said game board equipment;

a flat member hingedly secured to said container for at least partially covering said open area;

a game board having an extent substantially greater than said container;

said flat member having sufficient space between it and the container for receiving said game board;

small game board equipment parts for use with said game board mounted in said container; and means holding said game board firmly in place between said container and said flat member to fully close said open area on said container.

2. A game board carrier assembly as defined in claim 1 wherein said holding means includes pins for extending through said game board and holes in said hinged flat member for engaging said pins.

3. A game board carrier assembly as defined in claim 1 wherein said holding means includes strap means for holding the board to said container.

4. A game board carrier assembly as defined in claim 1 wherein said handle is large enough to receive a person's hand, and has a small central recess for centering the carrier when it is mounted in a sales display rack.

5. A game board carrier assembly as defined in claim 1 wherein said hinged flat member has an extent substantially conforming to that of said open area of said container, and wherein said holding means holds said flat member over said open area, whereby said game board pieces and equipment may be safely stored without loss, whether said game board is secured to said container or not.

6. A game board carrier assembly as defined in claim 1 wherein said container is a molded plastic container.

7. A game board carrier assembly as defined in claim 1 wherein said flat member has an extent slightly less than the space between the handle and the container.

8. A game board carrier assembly as defined in claim 1 wherein said carrier includes molded hinges interconnecting said flat member with said container.

9. A game board carrier assembly as defined in claim 1 wherein flat plate means is providing for covering at least some of the open area not covered by said flat member when it is pivoted to the closed position.

* * * * *